US007182489B2

(12) United States Patent
Yao et al.

(10) Patent No.: US 7,182,489 B2
(45) **Date of Patent: *Feb. 27, 2007**

(54) ELECTRICAL CANDLE LAMP

(75) Inventors: Hisn-Tien Yao, Taipei (TW); Teng-Huang Chen, Cheng Hua Hsien (TW); Andrew A. Boschetto, Sewell, NJ (US)

(73) Assignee: International Marketing Corporation, Tunersville, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/322,230

(22) Filed: Jan. 3, 2006

(65) Prior Publication Data

US 2006/0104068 A1 May 18, 2006

Related U.S. Application Data

(63) Continuation of application No. 10/444,097, filed on May 23, 2003, now Pat. No. 6,981,786.

(51) Int. Cl.
*F21S 4/00* (2006.01)

(52) U.S. Cl. ..... 362/392; 362/276; 362/569

(58) Field of Classification Search ..... 362/565, 362/811, 810, 800, 447, 392, 394, 802, 276, 362/183, 190, 191, 569; 431/297; 250/204, 250/205

See application file for complete search history.

(56) References Cited

U.S. PATENT DOCUMENTS

| | | | | |
|---|---|---|---|---|
| 5,152,602 | A * | 10/1992 | Boschetto | 362/276 |
| 6,497,502 | B1 * | 12/2002 | Clift et al. | 362/392 |
| 6,808,297 | B2 * | 10/2004 | Jensen et al. | 362/392 |
| 6,820,998 | B2 * | 11/2004 | Chen | 362/276 |
| 6,981,786 | B2 * | 1/2006 | Yao et al. | 362/392 |

* cited by examiner

*Primary Examiner*—Sandra O'Shea
*Assistant Examiner*—Bao Q. Truong
(74) *Attorney, Agent, or Firm*—Berenato, White & Stavish

(57) ABSTRACT

The electrical candle lamp comprises a translucent candlestick member having a lower end and an upper end, a support member provided at the lower end of the candlestick member, and a light emitting assembly secured to the upper end of the candlestick member. The light emitting assembly includes a base portion, a light emitting device mounted to the base portion and an electronic control unit for controlling operation of the light emitting device. The electronic control unit includes an ambient light sensor provided for automatically turning the light emitting device on if ambient light level is below a predetermined level and for turning the light emitting device off if ambient light level is above the predetermined level. The ambient light sensor protrudes through an opening formed in an outer surface of the base portion of the light emitting assembly and is exposed to ambient light.

23 Claims, 5 Drawing Sheets

ELECTRICAL CANDLE LAMP

This application is a Continuation Application of U.S. patent application Ser. No. 10/444,097 filed May 23, 2003 now U.S. Pat. No. 6,981,786. The disclosure of the prior application is hereby incorporated by reference herein in its entirety.

BACKGROUND OF THE INVENTION

1. Field of the Invention

The present invention relates to an electrical lamps in general, and is more particularly directed to a self-powered electrical candle lamp including an illumination device and an electronic control unit provided with an ambient light sensor provided for automatically turning the illumination device on and off in response to an ambient light level.

2. Description of the Prior Art

There currently exist electrical candlestick lamps including a light bulb and standard electrical cord and plug for connection with a conventional household outlet. Typically, these electrical type candlestick lamps include a plastic base connected to a plastic candlestick provided with an electrical socket for a conventional light bulb having a threaded type electrical connector base. A length of standard two wire electrical cord extends through the base and candlestick portion to connect with the electrical socket at one end and provided with a standard household plug at an opposite end thereof.

Other illuminated ornamental candlestick lamps of the prior art include self-powered devices in which the lamp is provided with a self-contained power supply. Example of such prior art devices is disclosed in U.S. Pat. No. 4,866,580 that discloses a self-powered ornamental lighting device including a power supply, a light bulb and a circuit means connecting the power supply and the light bulb. While such prior art devices provide improvement in the areas intended, there is still a great need for a simple, economical self-powered ornamental lighting device.

It is also known to incorporate a sensor for turning on and off a light fixture. Examples of known sensors include those which are responsive to ambient light or touch. The majority of small electrical devices in general, and light fixtures in particular, use a two-wire, non-grounded connection to a power source. This places a premium on proper insulation and solid construction to minimize the potential for electrical shock. Known sensors have been arranged in configurations wherein the ambient light sensors and the circuit means are disposed within the candlestick separately and spaced from the light bulb. In many instances it is more important to provide the circuit means which has a small aspect ratio to facilitate assembly within tubular cavities and provide a more streamlined appearance better suited to positioning along the length of a wire. Additionally, a sensor package having a small aspect ratio is easily encased by a tubular insulating sleeve.

In the case of ornamental light fixtures, their shape is often configured to resemble a comparable non-electrified device such as a candle or an oil lantern. Further, their external appearance is a primary concern since the light fixtures are intended to be displayed. In these cases, the availability of an unobtrusive cavity within the fixture to house the sensor is very restricted.

Therefore, it can be appreciated that there exist a continuing need for a new and improved electrical candle lamp utilizing an ambient light sensor in a compact, simple, inexpensive and easily assembled arrangement.

SUMMARY OF THE INVENTION

The present invention provides a new and improved electrical candle lamp provided for automatically turning the candle lamp on and off in response to an ambient light level.

The electrical candle lamp in accordance with the present invention comprises a candlestick member having a lower end and an upper end, a support member provided at the lower end of the candlestick member, and a light emitting assembly secured to the upper end of the candlestick member. The candlestick member has a substantially cylindrical shape and is made from a translucent material, such as clear, frosted, or textured glass or plastic. Preferably, the light emitting assembly is secured to the upper end of the candlestick member by a threaded coupling.

The light emitting assembly in accordance with the present invention includes a base portion, a light emitting device mounted to the base portion, and an electronic control unit for controlling operation of the light emitting device. The electronic control unit is disposed within the base portion and is operably coupled to the light emitting device. Disposed about a portion of the light emitting device is a translucent cover member ornamentally shaped like a candle flame and provided to enhance and simulate an open flame appearance of a conventional wax candlestick.

Preferably, the light emitting device is in the form of a light emitting diode (LED) mounted to the base portion and having an open flame appearance. Alternatively, the light emitting device may be in the form of a conventional replaceable incandescent light bulb adapted to be connected by a threaded coupling to a light bulb socket provided in the upper end of the candlestick member. It will be appreciated by those skilled in the art that other types of the light emitting device, such as fluorescent lamp, halogen lamp, etc., are also within the scope of the present invention.

The electronic control unit including an ambient light sensor provided for automatically turning the light emitting device on if ambient light level is below a predetermined level and for turning the light emitting device off if ambient light level is above the predetermined level. Preferably, the ambient light sensor is in the form of a photo-resistor, such as a cadmium sulfide (CDS) photo-resistor.

In accordance with the present invention, the electronic control unit is mounted within the base portion of the light emitting assembly except the ambient light sensor. The ambient light sensor protrudes through an opening formed in an outer peripheral surface of the base portion and is consequently exposed to the ambient light inside the translucent candlestick member. Such an arrangement of the light emitting assembly provides extremely compact packaging, and ease of assembling or replacing the burned LED.

The first exemplary embodiment of the electronic control unit of the light emitting assembly provides a simulated steady burn of an actual candle produced by the LED in low ambient light conditions, while the second exemplary embodiment of the electronic control unit of the light emitting assembly provides a simulated flickering flame of the actual candle produced by the LED in low ambient light conditions. Those skilled in the art will understand, however, that the invention can be used with many different types of control circuits.

The electrical candlestick device according to the present invention can be powered by batteries, solar cells, and/or from a conventional household A.C. outlet, or combinations thereof. In an embodiment utilizing batteries, the batteries can be stored in the candlestick member and/or support member of the electric candle lamp. In embodiments utilizing a solar cell, one or more solar cells located on the candlestick member, support member, or located remotely, is connected to batteries located in the candlestick member and/or support member so that the lamp charges during daylight hours and manually or automatically turns on for dusk and night use.

Therefore, the present invention provides a new and improved electrical candle lamp provided with an ambient light sensor mounted in a light emitting assembly in a compact and simple arrangement allowing easy assembly or replacement of the light emitting assembly.

BRIEF DESCRIPTION OF THE DRAWINGS

Other objects and advantages of the invention will become apparent from a study of the following specification when viewed in light of the accompanying drawings, wherein.

DETAILED DESCRIPTION OF PREFERRED EMBODIMENTS

The preferred embodiments of the present invention will now be described with the reference to accompanying drawings.

Figure 1:
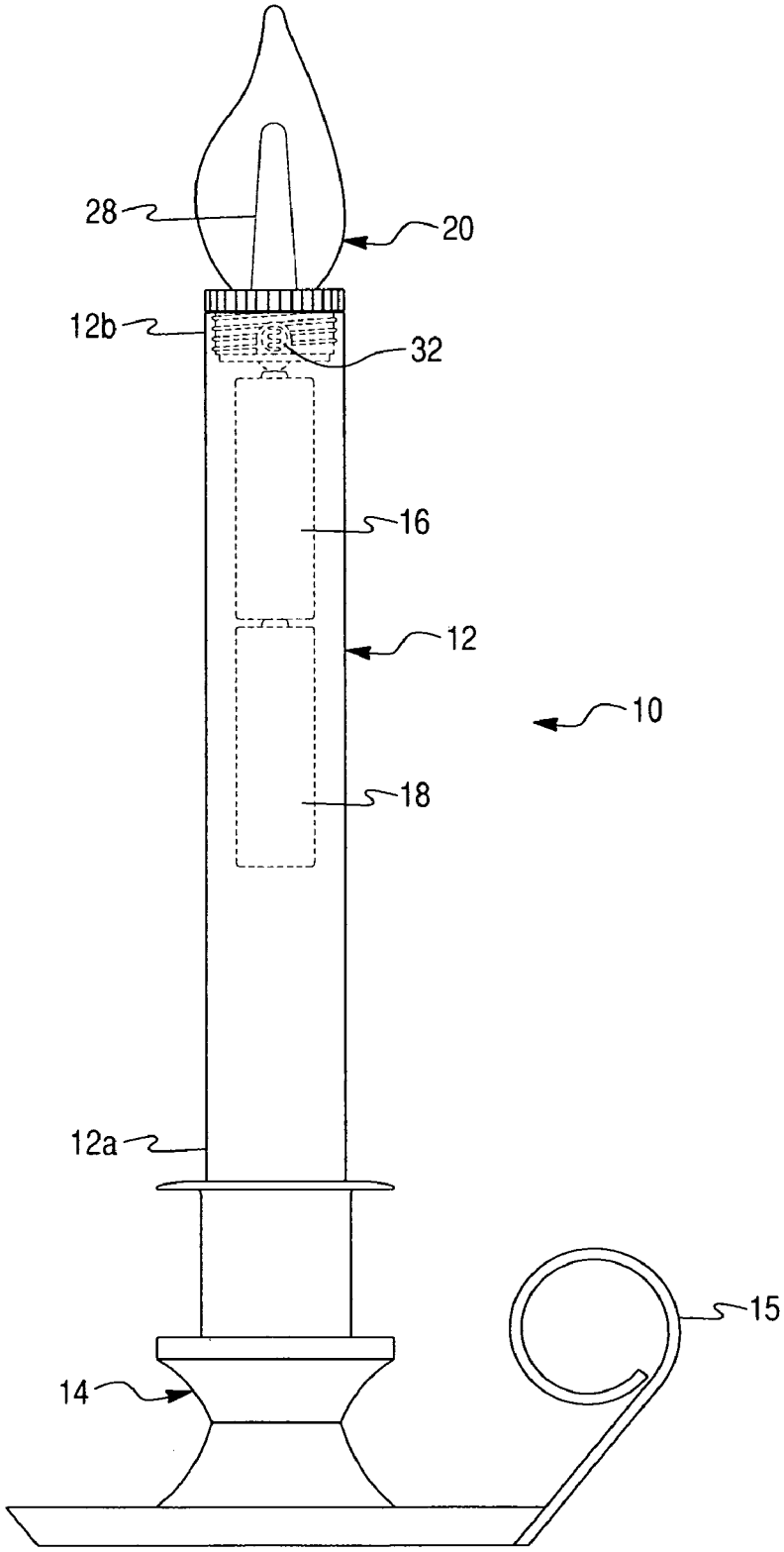
FIG. 1 is a side view of an electric candle lamp according to the preferred embodiment of the present invention.

For purposes of the following description, the terms "upper", "lower" and derivatives of such terms shall relate to the invention as oriented in FIG. 1 and are used for ease of explanation and are not limiting. However, it is to be understood that the invention may assume various alternative orientations, except where expressly specified to the contrary. It is also to be understood that the specific devices illustrated in the attached drawings, and described in the following specification are simply exemplary embodiments of the inventive concepts. Specific dimensions and other physical characteristics relating to the embodiments disclosed herein are not to be considered as limiting, unless expressly stated otherwise.

FIG. 1 of the drawings illustrates the preferred embodiment of an electric candle lamp, generally designated with the reference numeral 10, of the present invention provided for simulating an open flame.

As illustrated in FIG. 1, the electric candle lamp 10 comprises a candlestick member 12, an ornamental support member 14 provided at a lower end 12*a* of the candlestick member 12 for supporting thereof on any appropriate support surface, such as table, window sill, etc., and a light emitting assembly 20 secured to an upper end 12*b* of the candlestick member 12. As further illustrated in FIG. 1, preferably, the candlestick member 12 is substantially cylindrical part made from a translucent material, such as clear, frosted, or textured glass or plastic. The support member 14, preferably having a handle 15, supports the candlestick member 12 and the light emitting assembly 20.

Figure 2:
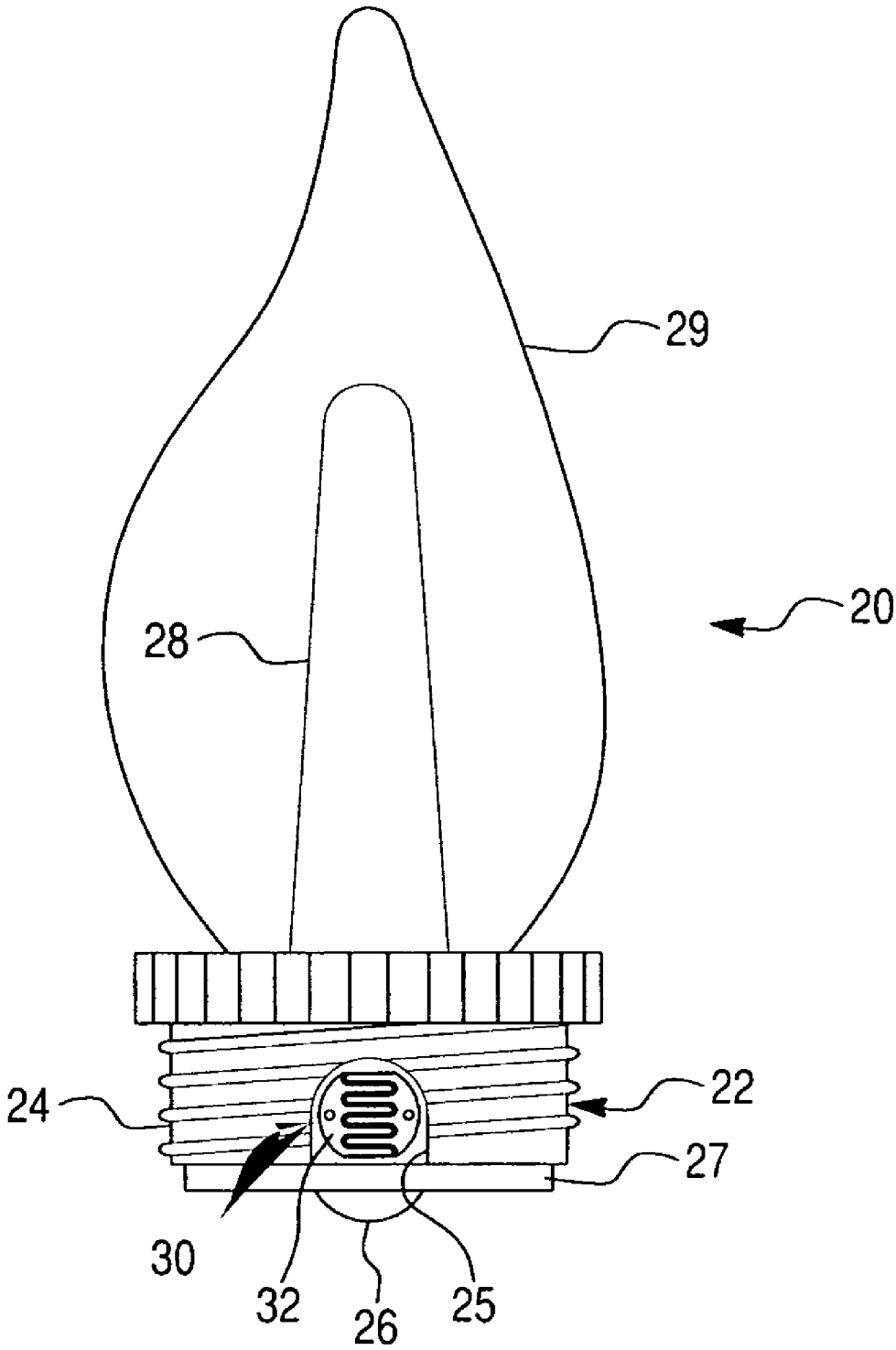
FIG. 2 is a side view of a light emitting assembly according to the preferred embodiment of the present invention.

As illustrated in detail in FIG. 2, the light emitting assembly 20 in accordance with the present invention includes a base portion 22, a light emitting device 28 mounted to the base portion 22, and an electronic control unit 30 provided for carrying an electrical current to the light emitting device 28 and for controlling operation of the light emitting device 28. The electronic control unit 30 is disposed within the base portion 22 and is operably coupled to the light emitting device 28. Disposed about a portion of the light emitting device 28 is a translucent cover member 29 ornamentally shaped like a candle flame and provided to enhance and simulate an open flame appearance of a conventional wax candlestick. The base portion 22 is further provided with a pair of spaced contacts 26 and 27.

Preferably, the light emitting assembly 20 is secured to the upper end 12*b* of the candlestick member 12 by a threaded coupling. Thus, as illustrated in FIG. 2, the base portion 22 of the light emitting assembly 20 has a substantially cylindrical threaded outer peripheral surface 24 complementary a substantially cylindrical threaded inner peripheral surface provided within the upper end 12*b* of the candlestick member 12.

Preferably, the light emitting device 28 is in the form of a light emitting diode (LED) mounted to the base portion 22 and having an open flame appearance. Alternatively, the light emitting device 28 may be in the form of a conventional replaceable incandescent light bulb adapted to be connected by a threaded coupling to a light bulb socket provided in the upper end 12*b* of the candlestick member 12. However, it will be appreciated by those skilled in the art that other types of electrical socket connections can be substituted therefore. Moreover, other types of the light emitting device 28, such as fluorescent lamp, halogen lamp, etc., are also within the scope of the present invention.

The electronic control unit 30 of the light emitting assembly 20 in accordance with the present invention further includes an ambient light sensor 32 provided for automatically turning the LED 28 on if ambient light level is below a predetermined level and for turning the LED 28 off if ambient light level is above the predetermined level. Generally, this level may be chosen based upon an average ambient light level available in a given locality at dusk.

Preferably, the ambient light sensor 32 is in the form of a photo-resistor, such as a cadmium sulfide (CDS) photo-resistor. An electrical resistance of the CDS photo-resistor varies as a function of the intensity of ambient light. In this invention, the LED 28 will be automatically switched on in low ambient light conditions as previously described.

It will be appreciated by those skilled in the art that the electronic control unit 30 may have a variable control (not shown) to set light sensitivity of the ambient light sensor 32 to a desired level.

In accordance with the present invention, as illustrated in FIG. 2, the electronic control unit 30 is mounted within the base portion 22 of the light emitting assembly 20 except the ambient light sensor 32. The ambient light sensor 32 is disposed in (or is recessed into an opening 25 formed in the outer peripheral surface 24 of the base portion 22 and is consequently exposed to the ambient light inside the translucent candlestick member 12. Such an arrangement of the light emitting assembly 20 provides extremely compact packaging, and ease of assembling or replacing the burned LED 28.

Figure 3:
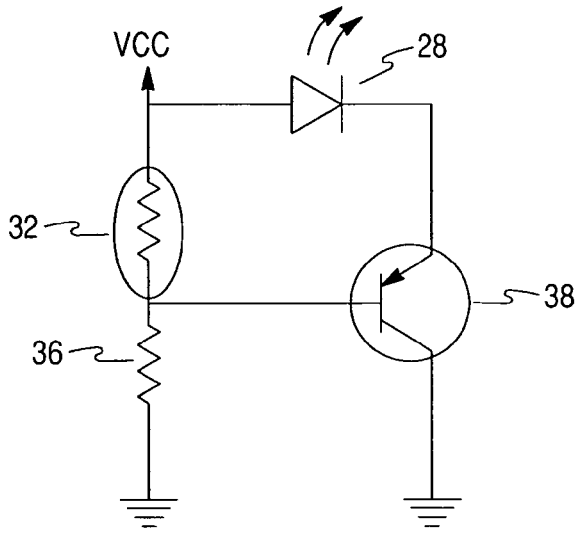
FIG. 3 is a schematic view of the first exemplary embodiment of an electronic control unit for controlling operation of the light emitting assembly in accordance with the present invention.

The first exemplary embodiment of the electronic control unit 30 of the light emitting assembly 20 provides a simulated steady burn of an actual candle produced by the LED 28 in low ambient light conditions. The schematic view of an electronic control circuit of the electronic control unit 30 of the light emitting assembly 20 in accordance with the first exemplary embodiment is illustrated in FIG. 3. The control circuit comprises the ambient light sensor 32 in the for of the CDS photo-resistor having a variable resistance R3, a resistor 36, and a transistor 38. These components together form the control circuit arrangement shown in FIG. 3 providing the simulated steady burn of the light produced by the LED 28 in low ambient light conditions.

Figure 4:
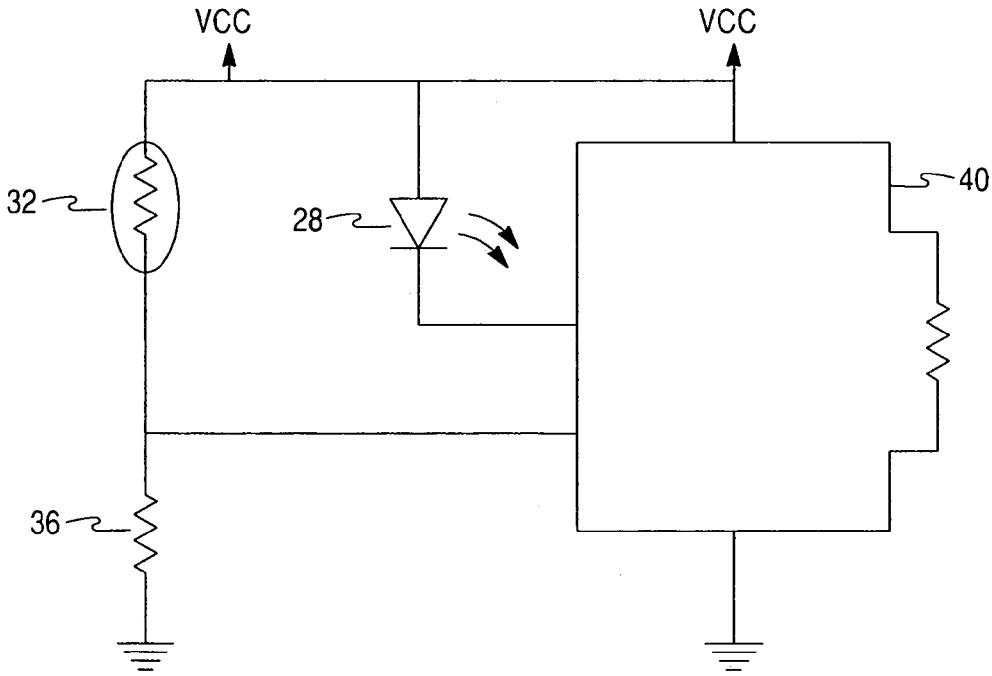
FIG. 4 is a schematic view of the second exemplary embodiment of the electronic control unit for controlling operation of the light emitting assembly in accordance with the present invention.

The second exemplary embodiment of the electronic control unit 30 of the light emitting assembly 20 provides a simulated flickering flame of the actual candle produced by the LED 28 in low ambient light conditions. The schematic view of the electronic control circuit of the electronic control unit 30 of the light emitting assembly 20 in accordance with the second exemplary embodiment is illustrated in FIG. 4. In this figure, parts corresponding to those of FIG. 3 have been designated by the same reference numeral. The control circuit comprises the ambient light sensor 32 in the for of the CDS photo-resistor having a variable resistance R3, a resistor 36, and an oscillator 40. These components together form the control circuit arrangement shown in FIG. 4 providing the simulated flickering flame of the actual candle produced by the LED 28 in low ambient light conditions by generating a control signal for varying the brightness of light emitted by the LED 28 during spaced periods of gradually increasing duration followed by periods of gradually decreasing duration so as to produce a flicker during successive periods. Thus, the purpose of the oscillator 40 is to vary the amount of one of a current, voltage, or resistance of the power provided to the LED 28 which directly impacts the intensity of the LED 28. The control circuit 20 is not intended to interrupt power provided to the LED 28, but simply to control the amount or potential to change the light intensity or brightness.

Those skilled in the art will understand, however, that the invention can be used with many different types of control circuits.

The electric candle lamp 10 according to the present invention can be powered by electric batteries, solar cells, and/or from a conventional household A.C. outlet, or combinations thereof. Preferably, as illustrated in FIG. 1, disposed within the cylindrical candlestick member 12 is provided an electric power supply for the light emitting assembly 20 which may be, for example, in the form of a pair of standard type AA electric batteries 16 and 18 operably coupled to the light emitting assembly 20. It will be appreciated by those skilled in the art that any other appropriate number or types of batteries may be employed, or the batteries can be stored in the support member 14 of the electric candle lamp 10.

Figure 5:
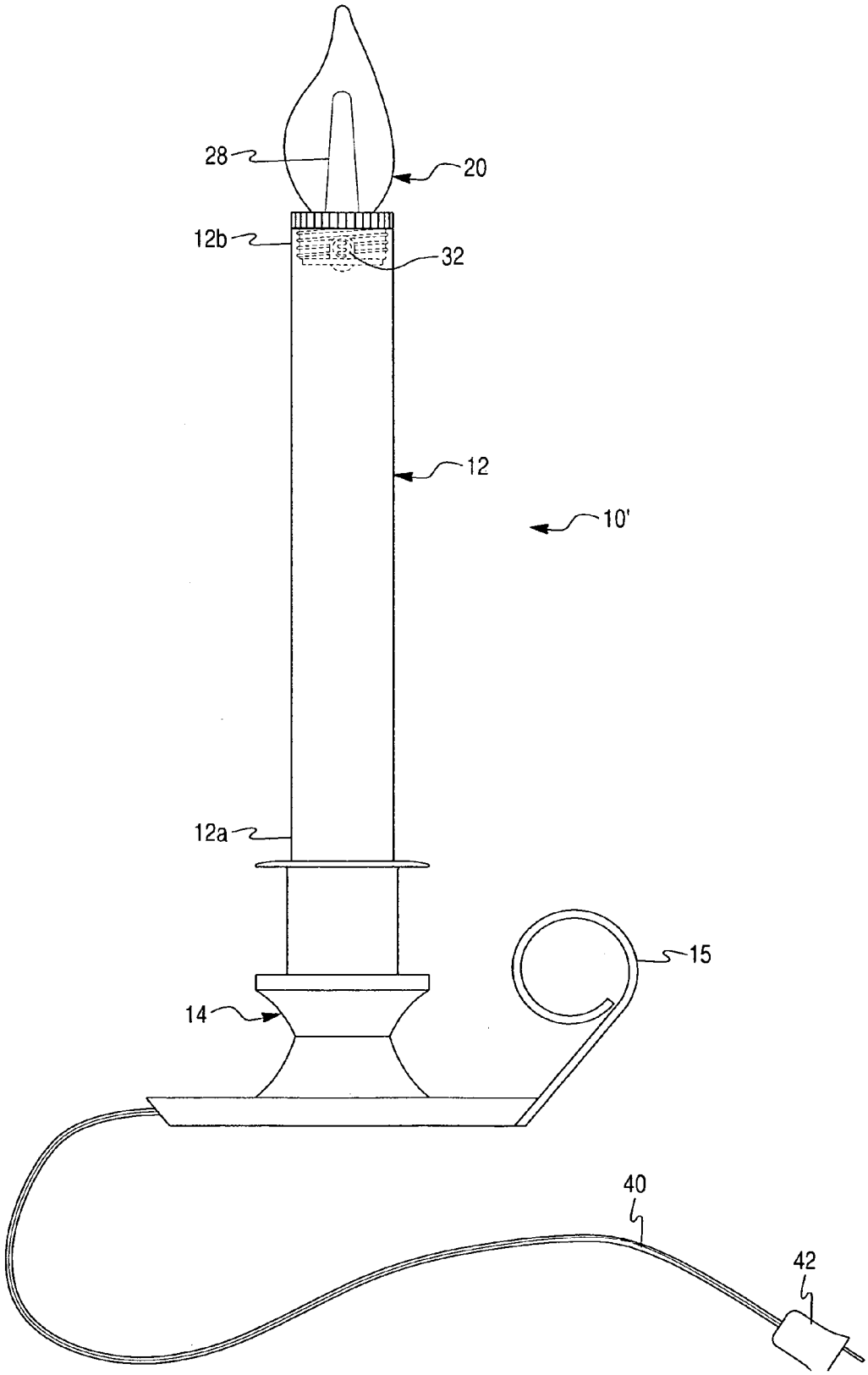
FIG. 5 is a side view of an electric candle lamp according to the alternative embodiment of the present invention.

Alternatively, as illustrated in FIG. 5, D.C. operating voltage for the light emitting assembly 20 may be provided by connecting it to a standard household A.C. power outlet (not shown). In this alternative embodiment utilizing conventional household residential or commercial electric power, an electrical candle lamp 10' includes a power cord 40 connected to the light emitting assembly 20 at one end and provided with a standard household electrical plug 42 at an opposite end thereof. In this embodiment of the electrical candle lamp 10' according to the present invention, the power cord 40 extends through the candlestick member 12 to connect with the light emitting assembly 20 located in the upper end 12*b* of the candlestick member 12, and extends down to the support member 14 of the electrical candle lamp 10'. The power cord 40 exits from the support member 14 of the electrical candle lamp 10.

Figure 6:
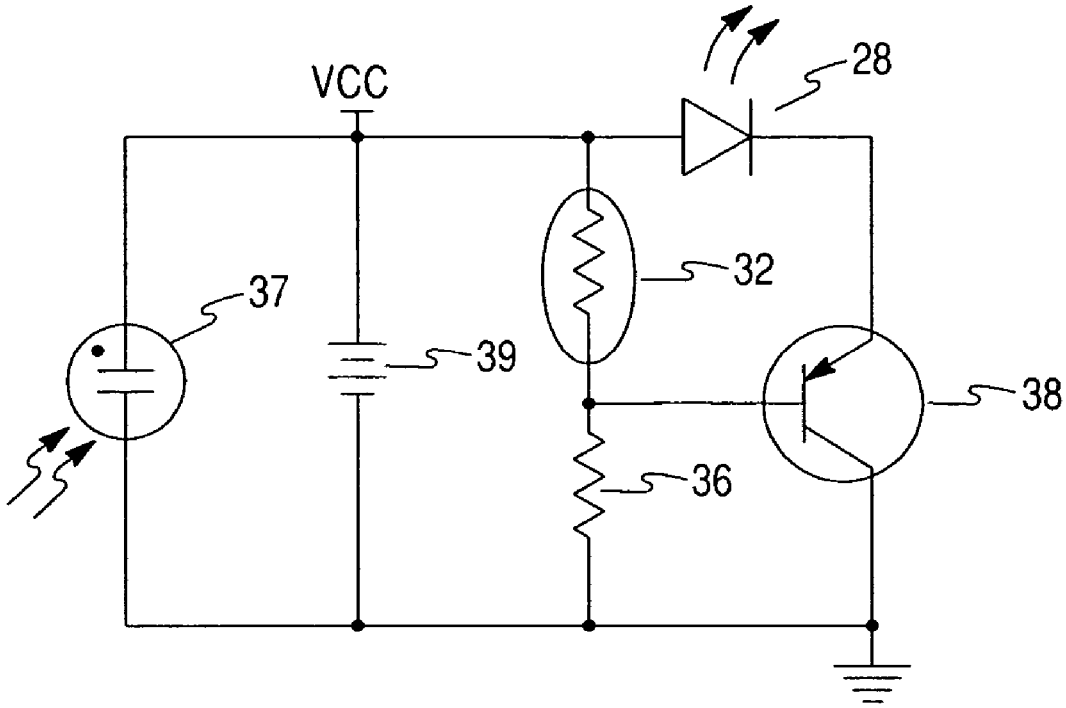
FIG. 6 is a schematic view of the third exemplary embodiment of an electronic control unit for controlling operation of the light emitting assembly in accordance with the present invention.

In the third exemplary embodiment of the electronic control unit 30, shown in FIG. 6, utilizing a solar cell, one or more solar cells 37 located on the candlestick member 12, support member 14, or located remotely, is connected to batteries 39 located in the candlestick member 12 and/49 or support member 14 so that the lamp charges the batteries 39 during daylight hours and automatically turns on for dusk and night use.

The operation of the electric candle will now be described in relation to the control circuit in accordance with the first exemplary embodiment of the electronic control unit 30 of the light emitting assembly 20 illustrated in FIG. 3. The resistance across the ambient light sensor 32 is inversely proportional to the ambient light level inside the translucent candlestick member 12, i.e. resistance is greatest when the light level is lowest and vice-versa. In high level ambient light, the resistance of the ambient light sensor 32 is quite low relative to the fixed resistance of the resistor 36. Therefore, the voltage drop across the resistor 36 consumes substantially the entirety of the source voltage and consequently, the signal voltage available at the gate 38*a* of the transistor 38 is insufficient to breakover the transistor 38 to pass current from the cathode to the anode. In low level ambient light,. the resistance of the ambient light sensor 32 is increased to an appreciable level. The voltage drop across the ambient light sensor 32, and hence the signal voltage available at the gate 38*a* of the transistor 38, is now sufficient to breakover the transistor 38 and pass current from the anode to the cathode of the transistor 38, illuminating the LED 28. The ambient light level which activates the ambient 20 light sensor 32 may be chosen based upon the average ambient light level available in a given locality at dusk.

The foregoing description of the preferred exemplary embodiments of the present invention has been presented for the purpose of illustration in accordance with the provisions of the Patent Statutes. It Is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. An electrical candle lamp comprising:

a candlestick member having a lower end and an upper end;

a support member provided at said lower end of said candlestick member; and a light emitting assembly secured to said upper end of said candlestick member;

said light emitting assembly including a base portion, a light emitting device mounted to said base portion and an electronic control unit provided for carrying an electrical current to said light emitting device and for controlling operation of said light emitting device;

said electronic control unit including an ambient light sensor provided for automatically turning said light emitting device on if an ambient light level is below a predetermined level and for turning said light emitting device off if ambient light level is above said predetermined level;

said light emitting assembly is removably secured to said upper end of said candlestick member.

2. The electrical candle lamp as defined in claim 1, wherein said electronic control unit is mounted within said base portion of said light emitting assembly.

3. The electrical candle lamp as defined in claim 1, wherein said ambient light sensor is recessed into an opening formed in an outer peripheral surface of said base portion of said light emitting assembly and is exposed to ambient light.

4. The electrical candle lamp as defined in claim 1, wherein said ambient light sensor is a photo-resistor.

5. An electrical candle lamp comprising:

a candlestick member having a lower end and an upper end;

a support member provided at said lower end of said candlestick member; and a light emitting assembly secured to said upper end of said candlestick member;

said light emitting assembly including a base portion, a light emitting device mounted to said base portion and an electronic control unit provided for carrying an electrical current to said light emitting device and for controlling operation of said light emitting device;

said electronic control unit including an ambient light sensor provided for automatically turning said light emitting device on if an ambient light level is below a predetermined level and for turning said light emitting device off if ambient light level is above said predetermined level;

said ambient light sensor recessed into an opening formed in an outer peripheral surface of said base portion of said light emitting assembly so as to be exposed to ambient light.

6. The electrical candle lamp as defined in claim 1, wherein said base portion of said light emitting assembly is provided with threads for removably engaging complementary threads provided in said upper end of said candlestick member.

7. The electrical candle lamp as defined in claim 1, wherein said candlestick member is made of a translucent material.

8. The electrical candle lamp as defined in claim 7, wherein said ambient light sensor protrudes through an opening formed in an outer peripheral surface of said base portion of said light emitting assembly and is exposed to ambient light within said translucent candlestick member.

9. The electrical candle lamp as defined in claim 1, wherein said light emitting device is a light emitting diode.

10. The electrical candle lamp as defined in claim 1, wherein said light emitting device is an incandescent light bulb.

11. The electrical candle lamp as defined in claim 10, further including an electrical socket provided in said upper end of said candlestick member for accommodating said incandescent light bulb.

12. The electrical candle lamp as defined in claim 1, further including at least one source of electric power operably coupled to said electronic control unit of said light emitting assembly.

13. The electrical candle lamp as defined in claim 12, wherein said at least one source of electric power is at least one electric battery.

14. The electrical candle lamp as defined in claim 13, further including at least one solar cell for recharging said at least one electric battery.

15. The electrical candle lamp as defined in claim 12, wherein said at least one source of electric power is at least one solar cell.

16. The electrical candle lamp as defined in claim 1, further including a power cord connected to said light emitting assembly at one end and provided with a standard household electrical plug at an opposite end thereof.

17. A light emitting assembly adapted to be secured to an electrical lamp, said light emitting assembly comprising:

a base portion;

a light emitting device mounted to said base portion; and an electronic control unit provided for carrying an electrical current to said light emitting device and for controlling operation of said light emitting device;

said electronic control unit including an ambient light sensor provided for automatically turning said light emitting device on if an ambient light level is below a predetermined level and for turning said light emitting device off if ambient light level is above said predetermined level;

said ambient light sensor recessed into an opening formed in an outer peripheral surface of said base portion of said light emitting assembly so as to be exposed to ambient light.

18. The light emitting assembly as defined in claim 17, wherein said electronic control unit is mounted within said base portion of said light emitting assembly.

19. The light emitting assembly as defined in claim 17, wherein said ambient light sensor is a photo-resistor.

20. The light emitting assembly as defined in claim 17, wherein said light emitting assembly is removably secured to said electrical lamp.

21. The light emitting assembly as defined in claim 20, wherein said base portion of said light emitting assembly is provided with threads for removably engaging complementary threads provided in said electric lamp.

22. The light emitting assembly as defined in claim 17, wherein said light emitting device is a light emitting diode.

23. The light emitting assembly as defined in claim 17, wherein said light emitting device is an incandescent light bulb.

* * * * *